US011034487B1

(12) United States Patent
Gardner et al.

(10) Patent No.: US 11,034,487 B1
(45) Date of Patent: Jun. 15, 2021

(54) RESERVOIR WITH STOPPER

(71) Applicant: Mercury Plastics LLC, Middlefield, OH (US)

(72) Inventors: Scott Raymond Gardner, Chagrin Falls, OH (US); Earl Christian, Jr., Chagrin Falls, OH (US); Donald Currey, Chagin Falls, OH (US); William Blue, Middlefield, OH (US)

(73) Assignee: Mercury Plastics LLC, Middlefield, OH (US)

( * ) Notice: Subject to any disclaimer, the term of this patent is extended or adjusted under 35 U.S.C. 154(b) by 9 days.

(21) Appl. No.: 16/457,955

(22) Filed: Jun. 29, 2019

Related U.S. Application Data

(60) Provisional application No. 62/692,358, filed on Jun. 29, 2018.

(51) Int. Cl.
*B65D 39/04* (2006.01)
*B65D 1/02* (2006.01)
*B65D 41/04* (2006.01)

(52) U.S. Cl.
CPC ..... *B65D 39/04* (2013.01); *B65D 1/0246* (2013.01); *B65D 41/0442* (2013.01); *B65D 41/0428* (2013.01)

(58) Field of Classification Search
CPC ..... B65D 39/08; B65D 39/04; B65D 43/021; B65D 51/1644; B65D 51/1633; B65D 51/16; B65D 41/0442; B65D 41/0435; B65D 41/0428; B65D 41/0407; B65D 1/0246; B65D 1/023; B65D 1/0223
USPC ..... 220/789, 780, 804, 801, 203.02, 203.28, 220/787, 784, 803, 802; 215/356, 355; 141/355; 137/116.3, 115.13, 115.01
See application file for complete search history.

(56) References Cited

U.S. PATENT DOCUMENTS 2,457,120 A * 12/1948 Brandon ..... B65D 51/002 215/247
2,954,045 A * 9/1960 Leek, Jr. ..... F16K 13/10 137/251.1
3,845,787 A * 11/1974 Slagle ..... B67D 1/102 137/571
4,342,419 A * 8/1982 Conway ..... B04B 7/06 220/361
4,517,884 A * 5/1985 Jandrich ..... C12G 1/0206 426/15
7,850,898 B1 * 12/2010 Rowley ..... B29C 49/20 264/514
2010/0101426 A1 * 4/2010 De Mei ..... B65D 81/245 99/277.1
2014/0262899 A1 * 9/2014 Mociak ..... B65D 51/1683 206/459.1

FOREIGN PATENT DOCUMENTS

GB 558998 A * 1/1944 ..... B65D 41/0435

* cited by examiner

*Primary Examiner* — Robert J Hicks
(74) *Attorney, Agent, or Firm* — Hahn Loeser & Parks LLP; Daniel J. Smola

(57) ABSTRACT

Examples herein relate generally to reservoirs for use in water distribution systems within an appliance. The reservoir herein allows for the combination of various components prepared by separate manufacturing processes and for reducing waste of those manufacturing components. Specifically, the reservoir herein provides a stopper separable from and for use with a container and a cap.

20 Claims, 11 Drawing Sheets

RESERVOIR WITH STOPPER

CROSS-REFERENCE TO RELATED APPLICATIONS

This application claims priority to, and the benefit of, U.S. Provisional Application No. 62/692,358 filed on Jun. 29, 2018 with the United States Patent Office, which is hereby incorporated by reference.

BACKGROUND

It is known to provide dispenser units within refrigerators, or other appliances, in order to enhance the accessibility to ice and/or water. Typically, such a dispenser unit will be formed in the freezer door of a side-by-side style refrigerator or in the fresh food or freezer door of a top mount style refrigerator. In either case or even in another location, a water line will be connected to the refrigerator in order to supply the needed water for the operation of the dispenser. For use in dispensing the water, it is common to provide a water tank within the fresh food compartment to act as a reservoir such that a certain quantity of the water can be chilled prior to being dispensed.

Certain dispenser equipped appliances available on the market today incorporate blow molded water tanks which are positioned in the fresh food compartments of the appliance, such as a refrigerator. More specifically, such a water tank is typically positioned in the back of the fresh food compartment, for example, behind a crisper bin or a meat keeper pan so as to be subjected to the cooling air circulating within the compartment. Since the tank is typically not an aesthetically appealing feature of the appliance, it is generally hidden from view by a sight enhancing cover.

For certain other dispenser equipped appliances, the reservoir may be molded, for example, by a process disclosed in U.S. Pat. No. 7,850,898, in which a heated extrudate is positioned in a mold followed by insertion of previously extruded profiles that are inserted into the beginning and end apertures of the main extrudate body. The mold is closed and pressure applied through the inserted profiles to expand the main extrudate body to fill the mold cavity, forming an essentially leak-proof seal between the extrudate body and the inserted profiles.

A molded reservoir requires significant set-up and manufacturing effort. What is needed is an improved reservoir and reservoir system that incorporate pre-manufacture or separately manufactured components using new and improved fittings or connections.

SUMMARY

The present disclosure described herein relates to a new reservoir and reservoir system for use in a water distribution system. What is disclosed herein is a reservoir useful in an appliance water dispensing system comprising one or more of the features hereinafter fully described and particularly pointed out in the claims. The following description and the annexed drawings set forth in detail certain illustrative embodiments, being indicative of but a few of the various ways in which the principles of the present disclosure may be employed.

In one example, a reservoir for use in a water distribution system within an appliance comprises:

- a container having a vessel structure terminating at a neck around an opening;
- a stopper inserted into and sealingly engaging the opening within the neck, the stopper comprising:
  - an internal surface in communication with an interior of the container;
  - an external surface opposite the internal surface;
  - an inlet aperture and an outlet aperture through the stopper in fluid communication with the opening of the container;
- an inlet tube in fluid communication with the inlet aperture; and
- an outlet tube in fluid communication with the outlet aperture.

The reservoir may further include a cap engaging the stopper and the container at the neck.

The foregoing and other objects, features, and advantages of the examples will be apparent from the following more detailed descriptions of particular examples, as illustrated in the accompanying drawings wherein like reference numbers represent like parts of the examples.

BRIEF DESCRIPTION OF THE DRAWINGS

Reference is made to the accompanying drawings in which particular examples and further benefits of the examples are illustrated as described in more detail in the description below, in which.

DETAILED DESCRIPTION

As used in this application, the term "overmold" means the process of injection molding a second polymer over a first polymer, wherein the first and second polymers may or may not be the same. An overmold having a specific geometry may be necessary to attach a tube to a fitting, valve, another tube, a diverter, a manifold, a fixture, a T connector, a Y connector or other plumbing or appliance connection. In one embodiment, the composition of the overmolded polymer will be such that it will be capable of at least some melt fusion with the composition of the polymeric tube. There are several means by which this may be affected. One of the simplest procedures is to insure that at least a component of the polymeric tube and that of the overmolded polymer is the same. Alternatively, it would be possible to ensure that at least a portion of the polymer composition of the polymeric tube and that of the overmolded polymer is sufficiently similar or compatible so as to permit the melt fusion or blending or alloying to occur at least in the interfacial region between the exterior of the polymeric tube and the interior region of the overmolded polymer. Another manner in which to state this would be to indicate that at least a portion of the polymer compositions of the polymeric tube and the overmolded polymer are miscible. In contrast, the chemical composition of the polymers may be relatively incompatible, thereby not resulting in a material-to-material bond after the injection overmolding process.

Figure 1:
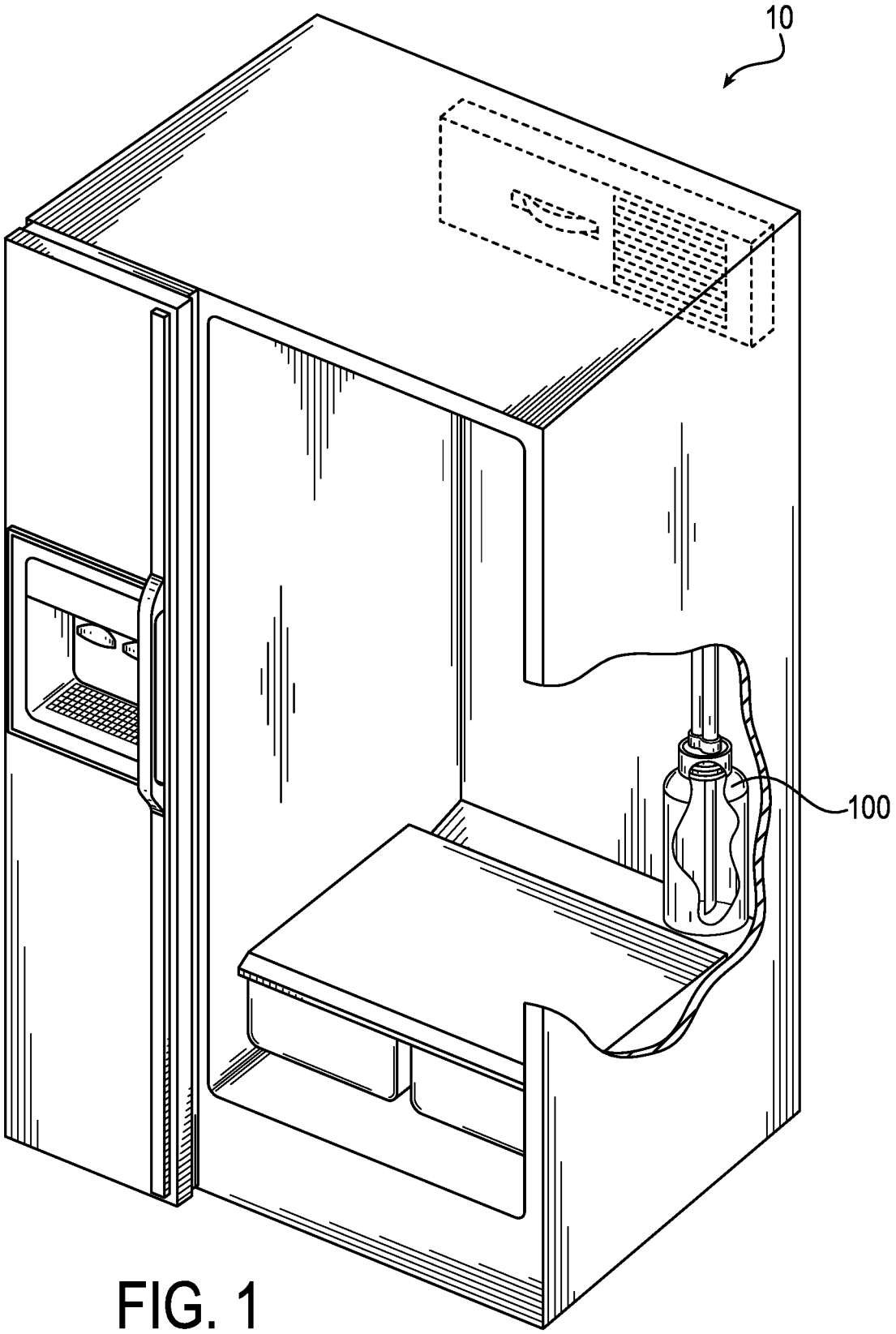
FIG. 1 is a partial perspective view of an appliance showing a diagrammatical cutaway view of a reservoir of the present disclosure.

Referring now to FIG. 1, an appliance 10 having a water dispensing system is shown. A reservoir 100 of the present disclosure is illustrated within the appliance 10. The reservoir 100 is a combination of separately manufactured components. The ability to combine separately manufactured components improves manufacturing availability, manufacturing lead-times, manufacturing set-up, and reduces manufacturing costs, to name a few advantages over prior reservoirs. Also, by separately manufacturing the components of the reservoir and utilizing the fittings of the present disclosure, the reservoir of the present disclosure provides different reservoir configurations or systems compatible with different appliances, while maintaining or reusing one or more manufacturing components, processes, or systems across the various configurations.

Figure 2:
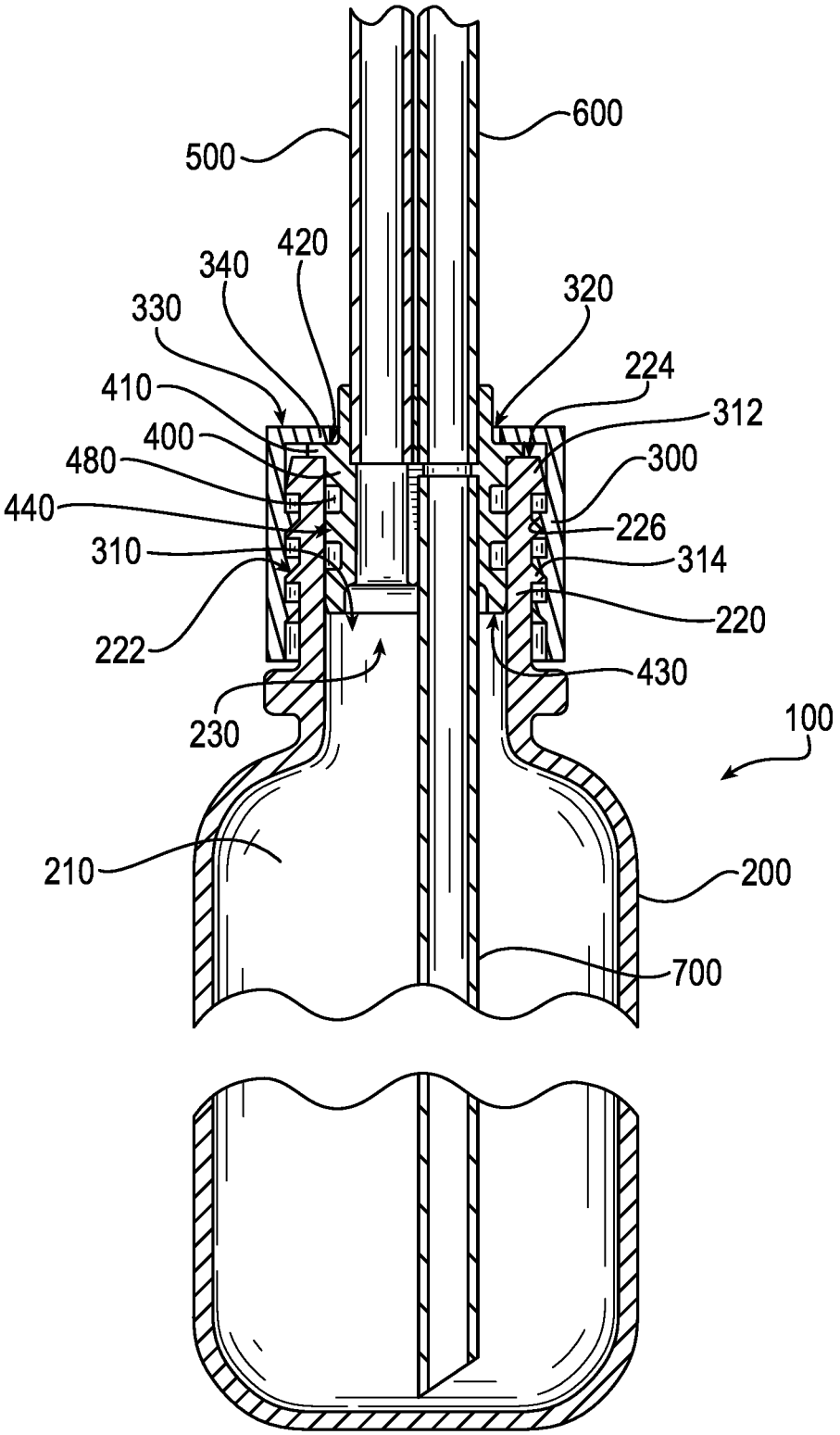
FIG. 2 is a partial cross-sectional view of the reservoir shown in FIG. 1 with the cross-section taken through section 2-2 of FIG. 3.

With reference to FIG. 2, the reservoir 100 of the present disclosure comprises a container 200, a cap 300, a stopper 400, an inlet tube 500, and an outlet tube 600. Each of these components may be separately manufactured and combined as described in the present disclosure. Further, each of these components may be interchangeable with a variety of configurations of corresponding components, thereby, increasing efficiency in manufacturing systems by manufacturing one or more components which are interchangeable across a variety of different systems. Moreover, each of these components are modifiable by simply adding an additional manufacturing step to a prior manufacturing set-up or an existing manufacturing process, in lieu of redefining the entire manufacturing set-up for the entire component. By example, the container and the cap may be manufactured as a mated pair, independent of a separately manufactured stopper and/or the inlet and/or outlet tube. The cap may be manufactured to sealingly engage the container creating a leak proof enclosure, or vacuum, within the container. To form a reservoir, as presently disclosed, the container and the cap, which may be pre-manufactured as described above, are modified to accommodate a stopper and/or the inlet and/or outlet tubes. To this end, both the pre-manufactured container and cap are used for creating the reservoir, thereby, reducing waste and manufacturing expense in lieu of manufacturing a new or different container and cap. In one example, an aperture is formed in the cap to accommodate a stopper as disclosed herein.

As shown in FIG. 2, the reservoir 100 includes a container 200 having a vessel structure 210. The vessel structure 210 terminates at a neck 220 around an opening 230. A cap 300 sealingly engages the neck 220. An interior cavity 310 of the cap encases an exterior perimeter 222, or a section thereof, of the neck 220. More specifically, an interior surface 312 of the interior cavity 310 of the cap 300 comprises threads 314 which engage and abut opposing threads 226 formed on the exterior perimeter 222 of the neck 220. The threads allow the cap to advance on and off of the neck 220 and provide for a sealed engagement between the cap 300 and the neck 220, as understood in the art for threaded fittings. Other methods for sealingly engaging the cap 300 to the neck 220 are contemplated herein, by example, a ratcheting connection, a friction connection, a barbed connection, a combination thereof, or the like. In some examples, the cap may be permanently attached to the neck of the vessel structure by permanent connections disclosed herein and understood in the art, examples of those being overmolding, adhesive, welding, a combination thereof, or the like.

Figure 3:
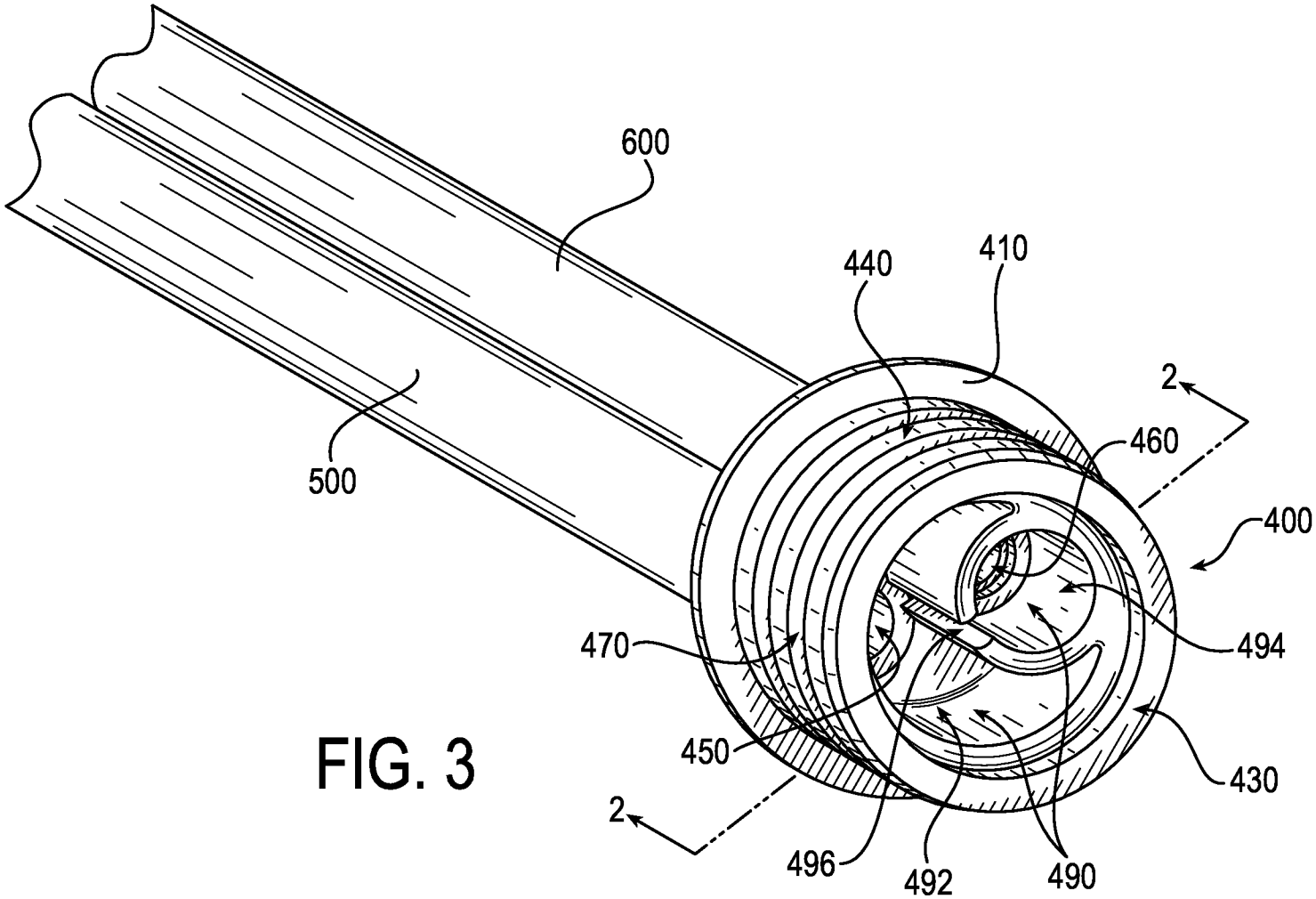
FIG. 3 is a perspective view of a stopper forming part of the reservoir of FIG. 1.
Figure 4:
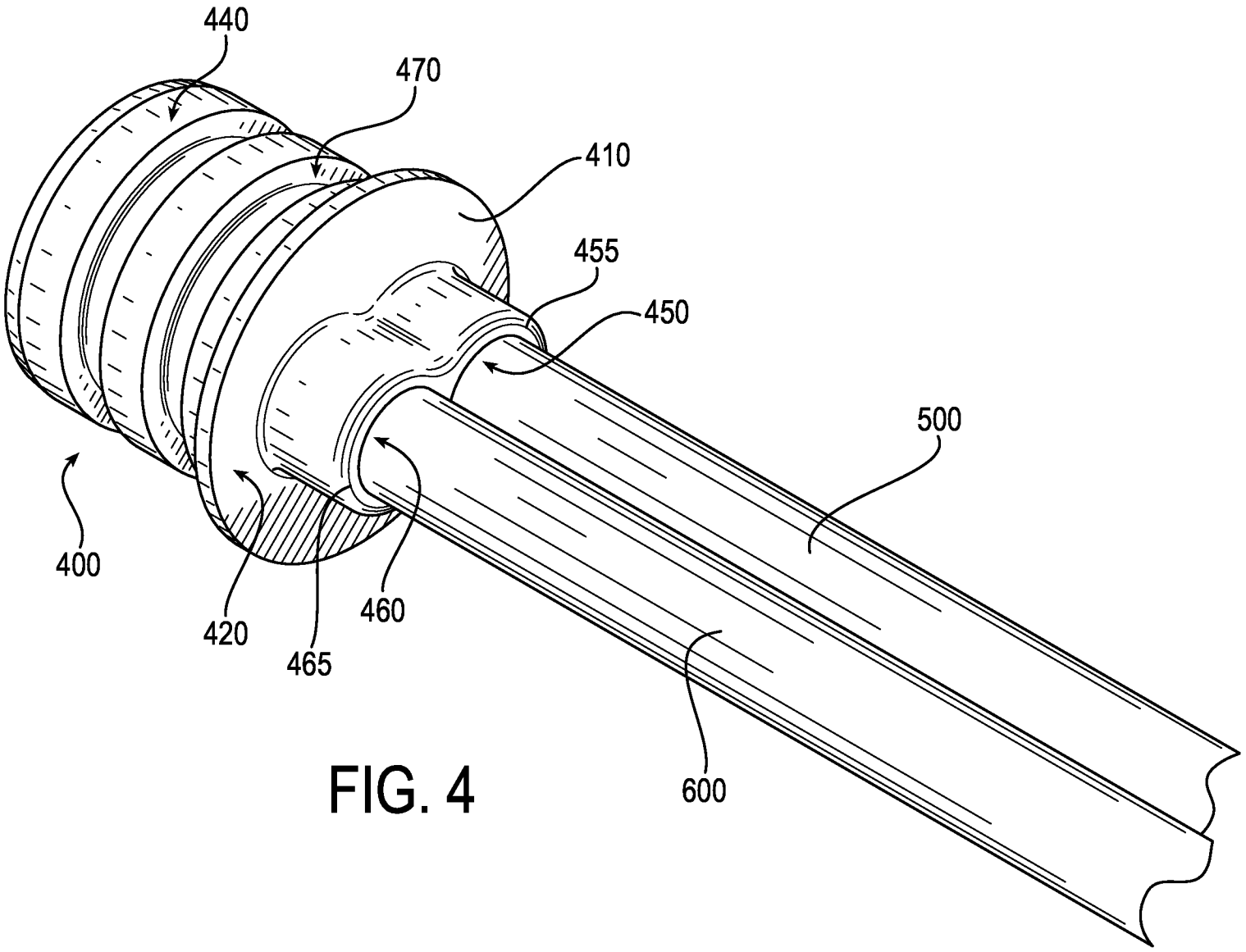
FIG. 4 is a perspective view of a stopper forming part of the reservoir of FIG. 1.
Figure 5:
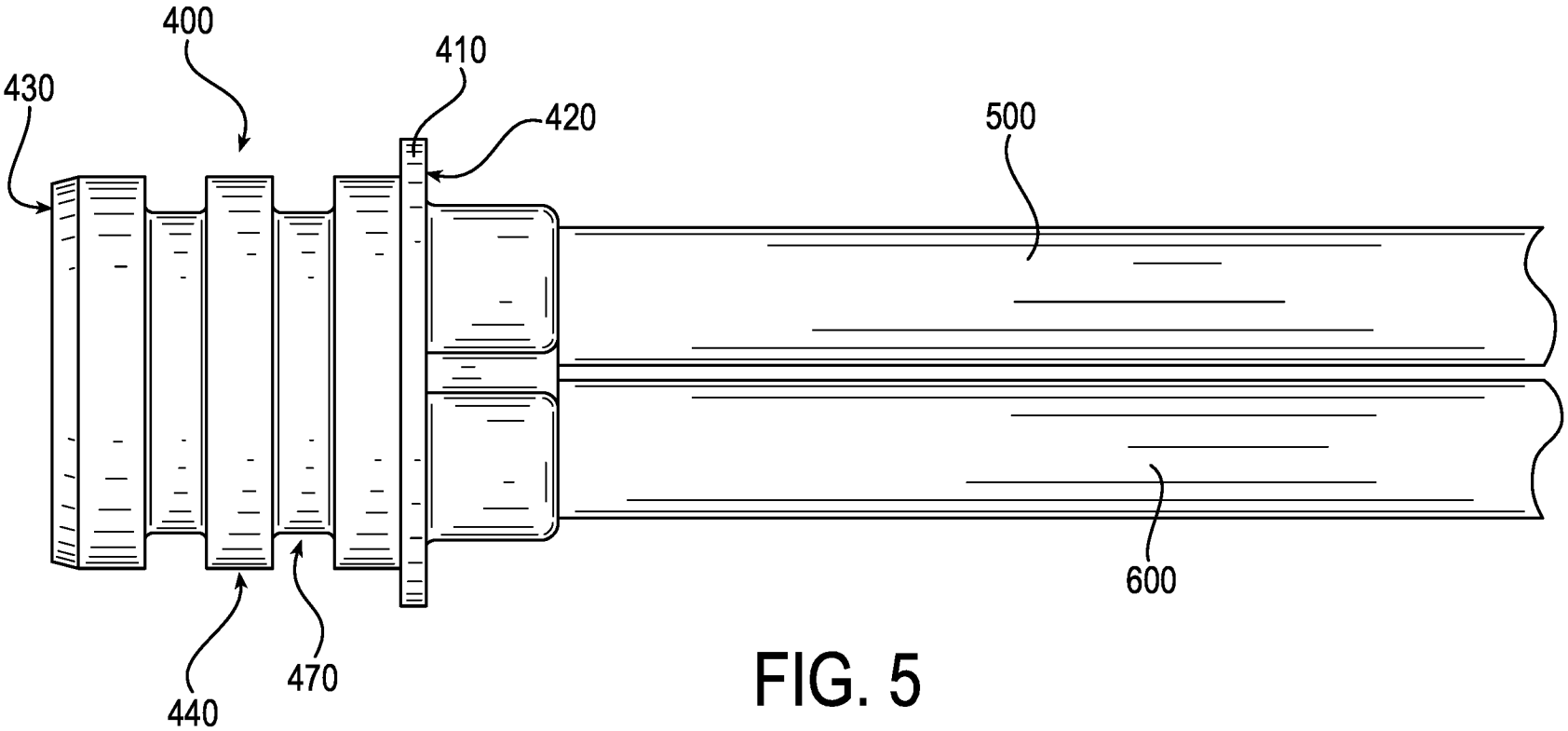
FIG. 5 is a side view of the stopper of FIG. 4.
Figure 8:
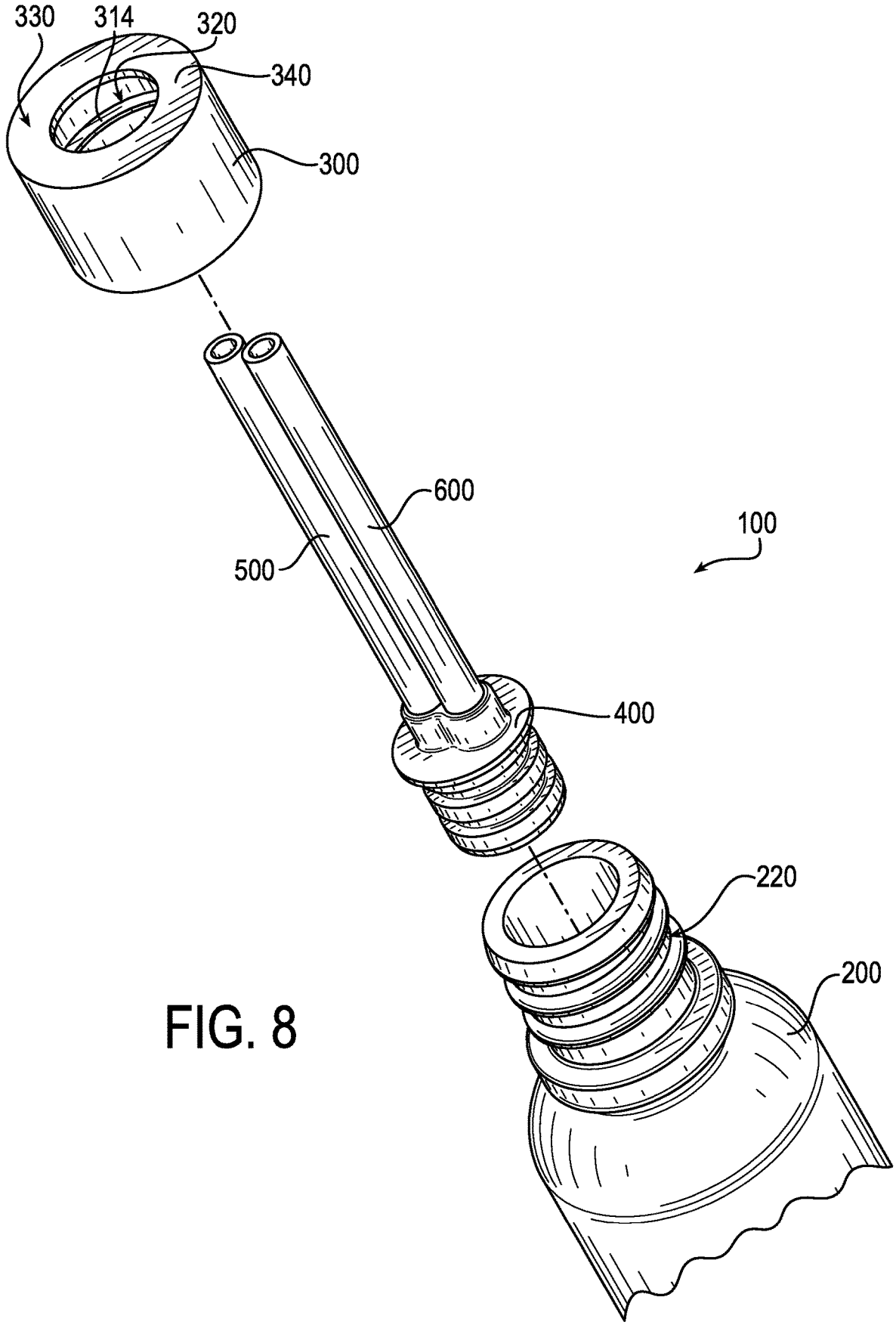
FIG. 8 is an exploded perspective view of the reservoir of FIG. 1 showing the container, stopper and cap separate from one another.
Figure 10:
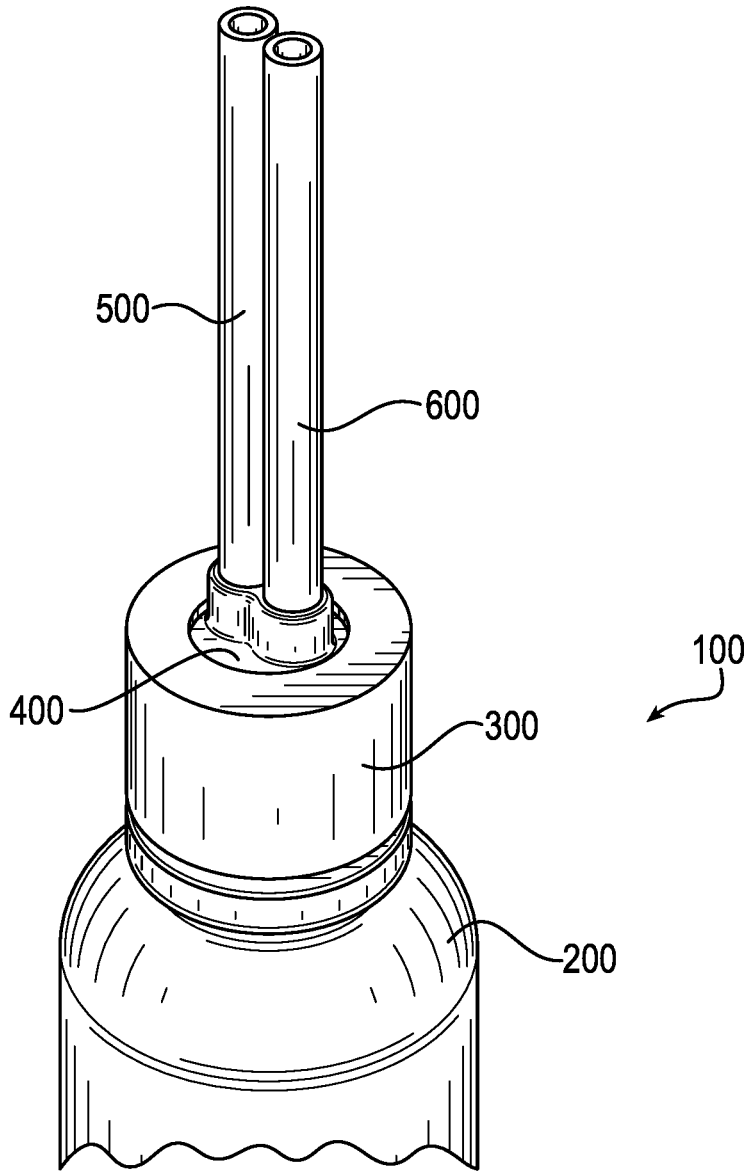
FIG. 10 is a perspective view of the reservoir of FIG. 1 showing the container, stopper and cap assembled.

An aperture 320 is formed in the cap 300 and extends from a top 330 of the cap into the interior cavity 310 of the cap as seen in FIGS. 2 and 8. The inlet and outlet tubes, 500, 600 extend through the aperture 320 of the cap 300 as shown in FIG. 10. The aperture may be formed into a pre-existing cap after manufacture of a cap. Alternatively, the aperture may be manufactured into the cap at the time of initial manufacture the cap. The cap 300 further comprises a top lip 340 adjacent the aperture 320 and positioned to the top 330 of the cap. In the example as illustrated by FIG. 2, the aperture 320 of the cap is smaller than the opening 230 and an external surface 420 of the stopper 400. In one example as illustrated by FIGS. 3-5, the stopper 400 comprises a flange 410 positioned at the external surface 420 of the stopper. The flange may be integrally formed on the stopper. In some examples, the flange may be separate from the stopper and adjoining the exterior surface of the stopper, separate from the stopper and adhered to the exterior surface of the stopper, and/or an extension of the one or more surfaces of the stopper. Referring to FIG. 2, the aperture 320 of the cap may additionally be smaller than one or more sections of the flange, or the entire flange. In other words, the top lip 340 extending about the aperture of the cap engages the flange and secures the flange between the top lip 340 of the cap and a top edge 224 of the neck. In this example, the top lip 340 of the cap does not engage the neck 220 and is separated from the neck 220 by the flange 410. Further, the stopper 400 is thereby secured within the opening 230 of the neck 220 by way of securing the flange 410 between the top lip 340 of the cap and the top edge 224 of the neck. The flange 410 may also be a seal or may be combined with a seal for forming a leak-proof connection between the cap, the neck, and/or the stopper. As illustrated by FIGS. 3-5 the flange is a cylindrical flange that extends the entire circumference of the top of the neck 220. Thus, a first seal is created as described above. Additionally, a second seal may be created between the stopper 400 and the neck 220 as discussed below.

As illustrated by FIG. 2, the stopper 400 is inserted into the opening 230 within the neck 220. In these examples, the stopper 400 is separable from the cap 300 and/or the neck 220. A leak-proof connection of the container 200 is formed at the opening 230 by way of engagement between the stopper 400 and the neck 220. Such a leak-proof connection may occur, for example, as a result of friction, by use of seals (e.g. gaskets, o-rings, or the like), overmolding, adhesive, a combination thereof, etc. In the example illustrated by FIGS. 3-5, one or more recesses 470 are formed within the stopper 400. The recesses 470 are formed at a perimeter 440 (also illustrated by FIG. 2) of the stopper 400, the perimeter engaging the neck 220 as illustrated by FIG. 2. A seal 480 may be positioned within each recess 470 for enhancing or forming a leak-proof connection between the stopper 400 and the neck 220. In the example illustrated by FIG. 2, the seal 480 is an o-ring. A more robust seal between the stopper 400 and the neck 220 is created with two o-rings as shown in FIG. 2. Therefore, the reservoir 100 may include a first seal (as described in Par. [0024]) and a second seal (between the stopper 400 and the neck 220) as discussed above to form a leak-proof connection.

As illustrated by FIGS. 3-5, the stopper 400 further comprises an external surface 420 and an internal surface 430. The internal surface 430 is in communication with an interior 210 of the vessel structure, as illustrated by FIG. 2. The external surface 420 is opposite the internal surface 430. In the example illustrated by FIGS. 3-5, the perimeter 440 of the stopper 400 engaging the neck 220, as illustrated by FIG. 2, is located between the internal surface 430 and the external surface 420 of the stopper. The stopper 400 includes an inlet tube support 455 and an outlet tube support 465, which extend from flange 410 as shown in FIGS. 4-5. The inlet tube support 455 includes an inlet aperture 450 and the outlet tube support 465 includes an outlet aperture 460. The inlet tube support 455 and the outlet tube support 465 may be molded as part of the stopper 400 or may be separate from the stopper 400. The inlet tube support and the outlet tube support may be integrally formed with one another or be separate from one another. When the reservoir 100 is assembled, the inlet aperture 450 and the outlet aperture 460 are in fluid communication with the opening 230 of the container 200 as shown in FIG. 2.

An inlet tube 500 and an outlet tube 600 may respectively connect to the inlet tube support 455 and the outlet tube support 465, and/or extend through the inlet aperture 450 and the outlet aperture 460, respectively, of the stopper 400. In one example, the stopper 400 is overmolded onto the inlet/outlet tubes at the inlet tube support 455 and the outlet tube support 465. In other examples, the inlet tubes and the outlet tubes may be secured to the inlet tube support and the outlet tube respectively by other means known in the art, such as adhesive, welding, a combination thereof, or the like. The inlet and outlet tubes may be partially inserted into, extend from, or extend through the inlet tube support and the outlet tube support, respectively. In the example as illustrated by FIG. 2, ends of the inlet tube 500 and the outlet tube 600 extend through the inlet tube support 455 and the outlet tube support 465, respectively. The inlet tube and/or the outlet tube, or sections of the inlet tube and/or outlet tube, may be flexible and/or comprise flexible tubing.

Figure 6:
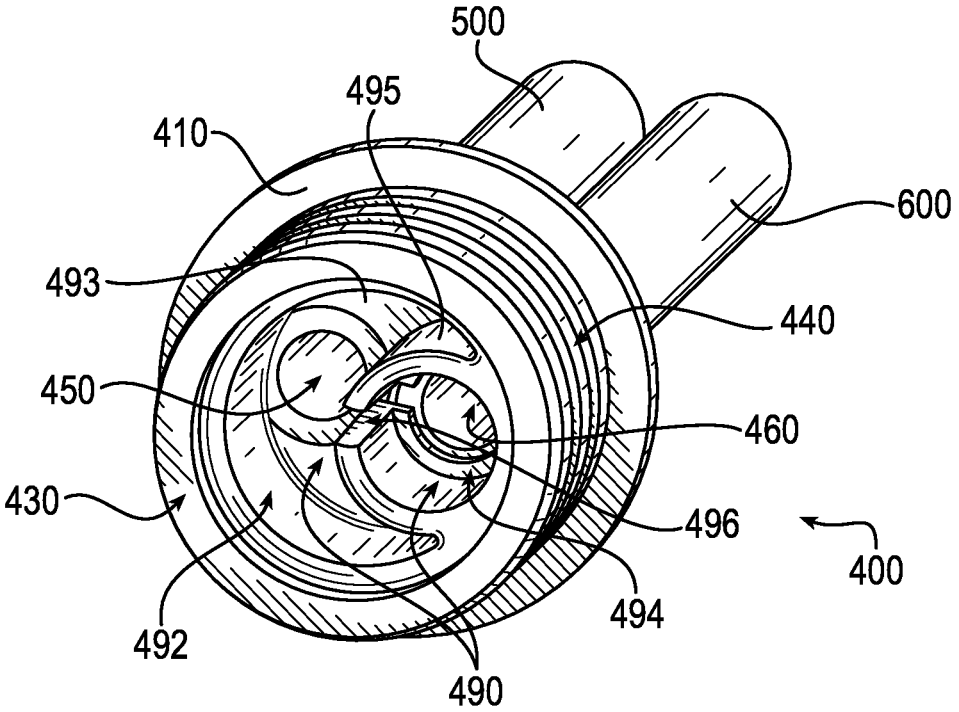
FIG. 6 is yet another perspective view of a stopper forming part of the reservoir of FIG. 1.
Figure 7:
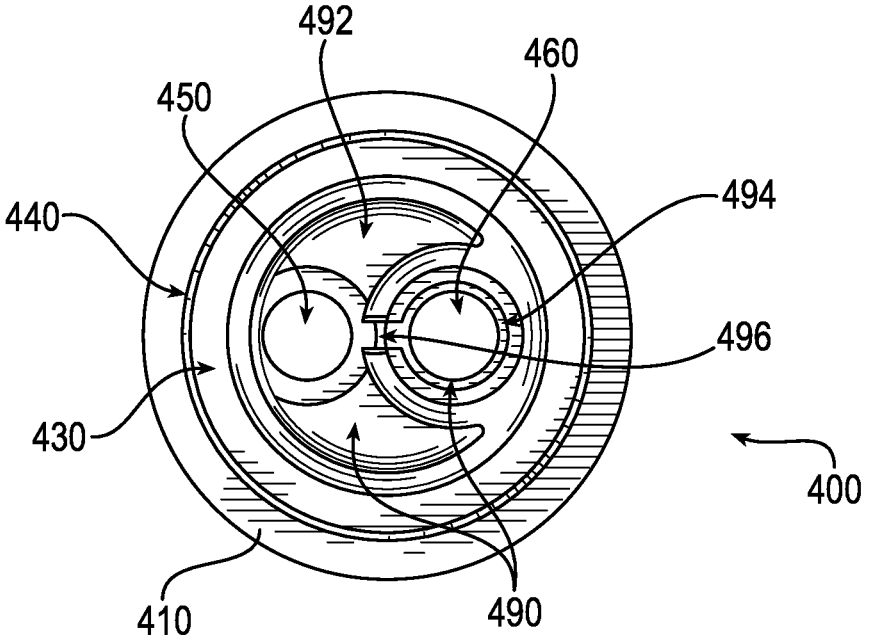
FIG. 7 is a bottom view of a stopper forming part of the reservoir of FIG. 1.
Figure 9:
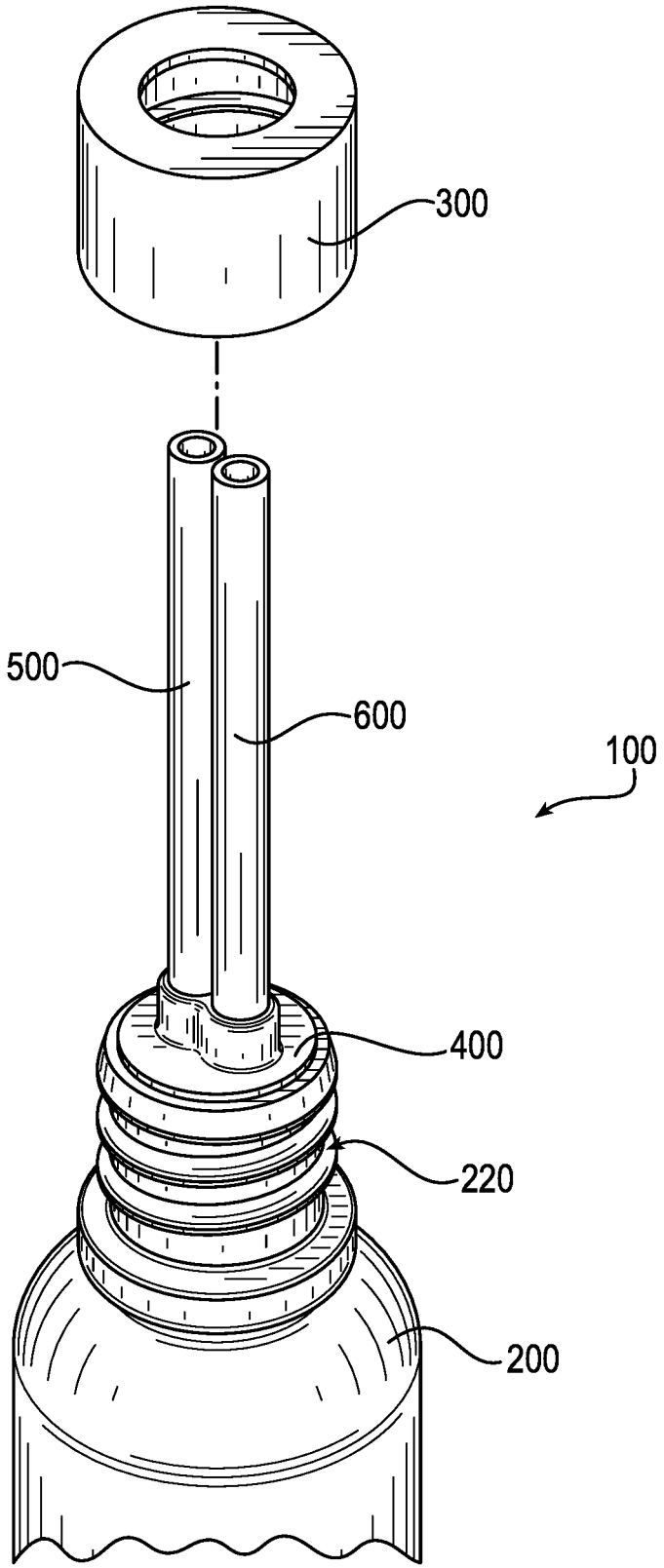
FIG. 9 is a perspective view of the reservoir of FIG. 1 showing the stopper engaged with the container and the cap removed.

FIGS. 8-10 display the reservoir 100 from a disassembled configuration to an assembled configuration. Specifically, FIG. 6 shows the container 200, the stopper 400 (with inlet/outlet tubes 500, 600 connected) and the cap 300 all separate from each other. FIG. 7 displays the stopper 400 (with inlet/outlet tubes 500, 600 connected) inserted within the neck 220 of the container 200, but the cap 300 separate. FIG. 10 illustrates the reservoir 100, with the container 200, the stopper 400 (with inlet/outlet 500, 600 tubes) and the cap 300 all assembled.

For certain applications, at least a portion of the inlet tube and/or the outlet tube may be integrally formed with the stopper. As an alternative to overmolding as described above, the inlet tube and/or the outlet tube may comprise a barb fitting, threaded fitting, or the like for engagement or connection with the stopper. Alternatively, the inlet tube and/or the outlet tube may be a tube fitting or connection integral to the stopper, a molded tubular portion, or an attached length of the tube.

As shown by FIGS. 3 and 6-7, the stopper 400 may further comprise a stopper cavity 490 that is open to the internal surface 430 of the stopper 400 and, thereby, the opening 230 of the container 200 (as illustrated by FIG. 2). The stopper cavity 490 is separated from the external surface 420 by the perimeter 440 and/or the flange 410 of the stopper. In the example of FIGS. 3 and 6-7, the inlet aperture 450 and/or the inlet tube 500 opens into a first side 492 of the stopper cavity 490. The first side 492 of the stopper cavity forms the shape of a crescent moon in the example FIGS. 3 and 6-7. However, any shape is contemplated herein. A second side 494 of the stopper cavity 490 forms an extension of the outlet aperture 460 and/or the outlet tube 600. A cylindrical wall 495 extends downwardly into the stopper cavity 490 from a stopper cavity upper surface 493 to accommodate a dip tube 700 as described below. The cylindrical wall 495 may extend partially into the stopper cavity 490 or may extend fully into the stopper cavity 490 and terminate at internal surface 430. In order to fill the reservoir to a desired level and subsequently dispense water in the upright vertical orientation shown in FIG. 2, the reservoir must vent air from the container 200 while the container fills with water to its desired level. The cylindrical wall 495 includes a fluid transfer opening 496. The fluid transfer opening 496 provides fluid communication between the first side 492 and the second side 494 of the stopper cavity 490 when the dip tube 700 is inserted. The fluid transfer opening 496 is for the transfer of fluids, including gases and liquids, to assist in the appropriate flow of fluids through the reservoir. In the example as illustrated by FIGS. 3 and 6-7, the fluid transfer opening 496 extends in the axial direction of the outlet tube 600. The fluid transfer opening 496 facilitates the venting of air. In particular, a dip tube 700 (as illustrated by FIG. 2) may be frictionally inserted into the second side 494 of the stopper cavity 490. However, the dip tube is only partially inserted into the second side 494 of the stopper cavity 490. As a result, a section of the fluid transfer opening 496 remains open between the first side 492 and the second side 494 of the stopper cavity 490. Therefore, a gap exists between the outlet tube 600 and the dip tube 700 (as illustrated by FIG. 2), which allows air to be vented from the container 200 (as illustrated by FIG. 2) through the fluid transfer opening 496 and out through the outlet tube 600. Moreover, the fluid transfer opening 496 is adjustable in size, and may be adjusted by the distance or amount the dip tube 700 (as illustrated by FIG. 2) extends into the second side 494 of the stopper cavity 400. For example, the fluid transfer opening 496 will decrease in size the more the dip tube 700 (as illustrated by FIG. 2) extends into the second side 494 of the stopper cavity 490. Likewise, the fluid transfer opening 496 will increase in size the less the dip tube 700 (as illustrated by FIG. 2) extends into the second side 494 of the stopper cavity 490. Increasing or decreasing the size of the fluid transfer opening may be desirable to either increase or decrease the rate at which fluid is emptied from the reservoir. A tube stop 498 may be provided in the cylindrical wall 495 to locate an end of the dip tube 700 in forming the fluid transfer opening 496, where the tube stop 498 prevents a fully-inserted dip tube 700 from contacting the stopper cavity upper surface 493 so the fluid transfer opening maintains fluid communication between the first side 492 and the second side 494 of the stopper cavity 490. The fluid transfer opening 496 may comprise any type of opening or openings in the cylindrical wall 495, such as holes, slots or other openings.

The dip tube 700 may be in fluid communication with either the inlet tube or the outlet tube, depending on the desired application. As illustrated by FIG. 2, the dip tube 700 is in fluid communication with the outlet tube 600 and/or the outlet aperture and extends into the opening 230 of the container 200 and the vessel structure 210. The dip tube 700 may extend into the entire length of the vessel structure 210 or into a partial length of the vessel structure 210. Like the inlet tube 500 and/or the outlet tube 600 extending from the vessel structure, the dip tube 700, or sections of the dip tube, may be flexible and/or comprise flexible tubing.

For certain applications, air may flow out of the containers through the outlet tube without the addition of a fluid transfer opening as discussed below. Whether or not a fluid transfer opening is required is determined in part by the orientation of the reservoir in its installed position, whether a dip tube is provided on the inlet or the outlet, the position of the outlet aperture and/or the end of the outlet dip tube, and other factors. For example, in FIG. 2, the reservoir is oriented in an upright vertical position, and dip tube 700 is provided at the outlet aperture 460. If no air vent were provided, the reservoir would stop filling at the depth of the end of the dip tube because the air in the container would be captured.

Figure 11:
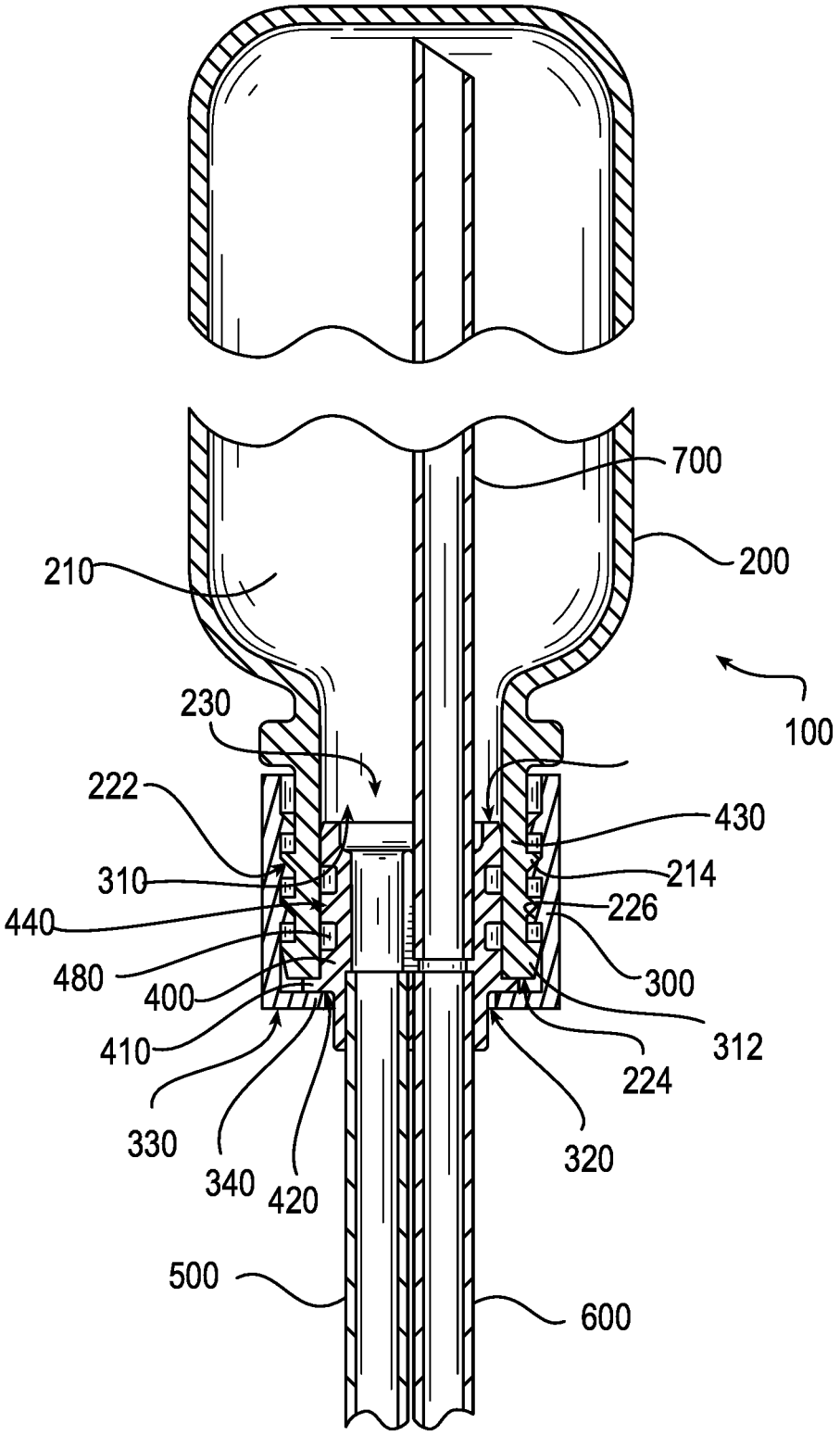
FIG. 11 is cross-sectional view of a reservoir for installation in an appliance in an inverted orientation.
Figure 12:
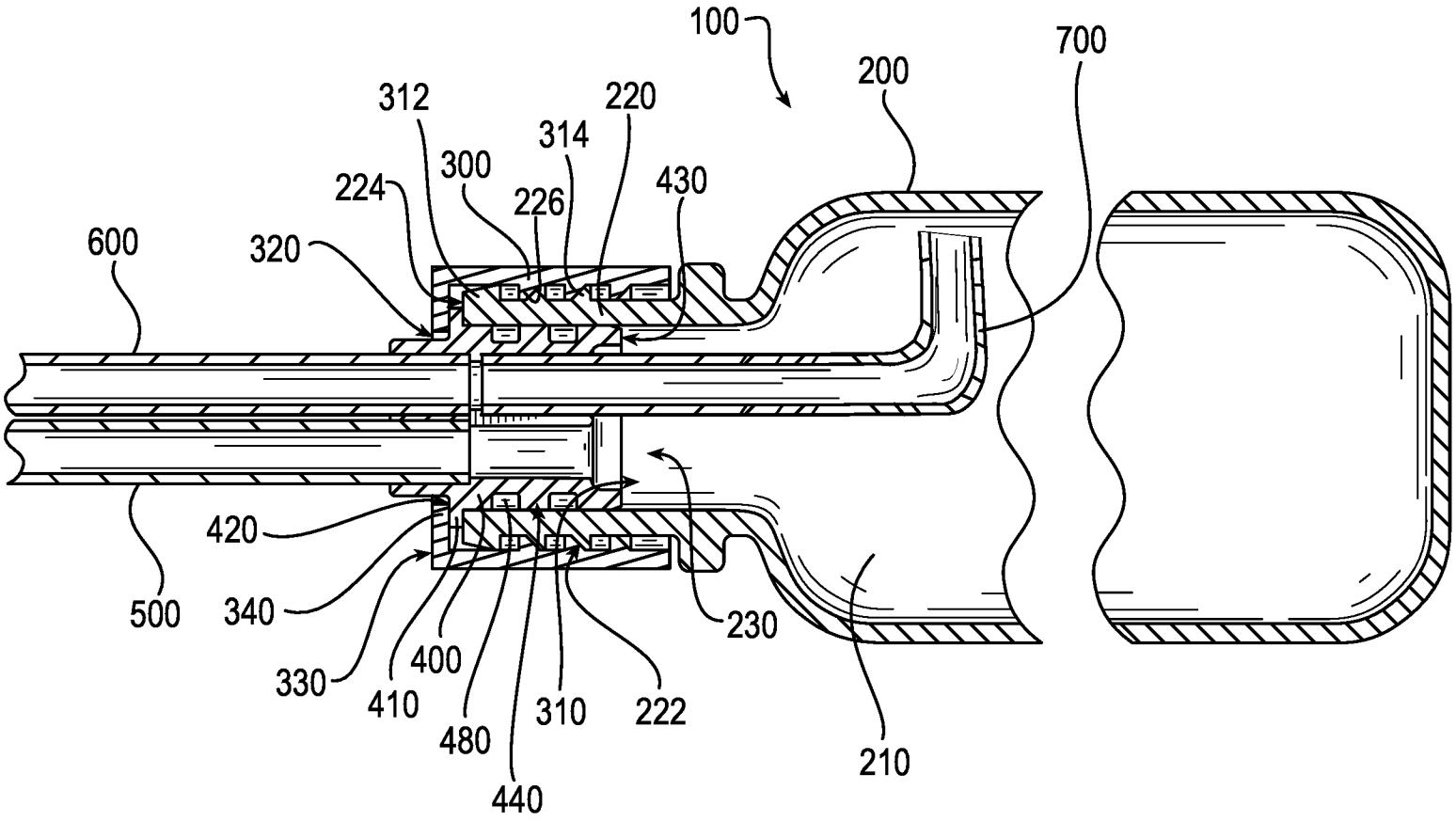
FIG. 12 is a cross-sectional view of a reservoir for installation in an appliance in a horizontal or sideways orientation.

In an alternative embodiment, no fluid transfer opening or air vent would be needed if the orientation of the reservoir was inverted (i.e. if FIG. 2 was upside down). In this example, the air would exit into the bottom of the dip tube 700 and out through the outlet tube 600. Such an example is illustrated by FIG. 11, where the features of FIG. 11 are illustrated as previously described with respect to FIG. 2. Still yet, in another example, as illustrated by FIG. 12, the vessel structure 210 is in a horizontal or sideways orientation. Likewise, the dip tube 700 may be arranged (e.g. bent) to facilitate air passage out through the outlet tube 600 without the use of an air vent. In one example, the dip tube 700 is an L-shaped dip tube, although the dip tube may be curved or arched. These examples illustrate the various orientations or configurations, or even a combination of configurations to facilitate positioning of the reservoir within an appliance.

The container 200 may be made of polyethylene terephthalate (PET), polycarbonate, aluminum, stainless steel or other suitable material. The container 200 may be formed from a multilayer material. A barrier film may be provided in at least one layer of the multilayer material, where the barrier layer inhibits passage of one or more from the group consisting of oxygen, carbon dioxide, water vapor, molecules affecting taste, molecules affecting odor. In one example, the container 200 and cap 300 are an off-the-shelf bottle and cap. The use of off-the-shelf existing bottle preforms and caps significantly reduces the tooling expense. Because existing threads that connect to the bottle are included in the off-the-shelf screw cap, it is not necessary to manufacture any threads as part of the stopper 400. This makes the manufacturing process of the stopper easier, quicker and less expensive, where one example of manufacturing is overmolding. The present disclosure allows for the inlet and outlet tubes and the stopper 400 to be overmolded together in a single manufacturing operation. Additionally, because the stopper 400 is inserted into the opening of the neck 220 of the container or bottle 200, seals or o-rings may be included with the stopper 400 to create a more robust seal between the stopper 400 and the container or bottle 200.

In certain embodiments, the container 200 is a bottle, such as a bottle formed by injection blow molding. A bottle formed by injection blow molding may be useful in providing a strong material, such as PET, polycarbonate, or the like, at an efficient cost. In some examples, one or more of the stopper, the inlet tube, and the outlet tube are made from polymers known in the art including, but not limited to, polyethylene, polypropylene, PVC, polystyrene, nylon, polytetrafluoroethylene and thermoplastic polyurethanes.

In some examples, one or more of the stopper, the inlet tube, and the outlet tube are made from high density polyethylene which is crosslinked, although the process described herein can be used with tubes made from any crosslinked polymers. Such polymers may include, but are not limited to, nylon, EVA, PVC, metallocine, polypropylene, polyethylene, silicone, rubber and EPDM. Crosslinked polyethylene, also known as PEX, contains crosslinked bonds in the polymer structure changing the thermoplastic into a thermoset. Crosslinking may be accomplished during or after extrusion depending on the method of crosslinking. The required degree of crosslinking for crosslinking polyethylene tubing, according to ASTM Standard F 876, is between 65-89%. However, the present process contemplates that the tube may be partially crosslinked. In one example, the tube may only be crosslinked to 40%. There are three classifications of PEX, referred to as PEX-A, PEX-B, and PEX-C. PEX-A is made by peroxide (Engel) method. In the PEX-A method, peroxide blending with the polymer performs crosslinking above the crystal melting temperature. The polymer is typically kept at high temperature and pressure for long periods of time during the extrusion process. PEX-B is formed by the silane method, also referred to as the "moisture cure" method. In the PEX-B method, silane blended with the polymer induces crosslinking during secondary post-extrusion processes, producing crosslinks between a crosslinking agent. The process is accelerated with heat and moisture. The crosslinked bonds are formed through silanol condensation between two grafted vinyltrimethoxysilane units. PEX-C is produced by application of an electron beam using high energy electrons to split the carbon-hydrogen bonds and facilitate crosslinking.

Crosslinking imparts shape memory properties to polymers. Shape memory materials have the ability to return from a deformed state (e.g. temporary shape) to their original crosslinked shape (e.g. permanent shape), typically induced by an external stimulus or trigger, such as a temperature change. Alternatively or in addition to temperature, shape memory effects can be triggered by an electric field, magnetic field, light, or a change in pH, or even the passage of time. Shape memory polymers include thermoplastic and thermoset (covalently crosslinked) polymeric materials.

Shape memory materials are stimuli-responsive materials. They have the capability of changing their shape upon application of an external stimulus. A change in shape caused by a change in temperature is typically called a thermally induced shape memory effect. The procedure for using shape memory typically involves conventionally processing a polymer to receive its permanent shape, such as by molding the polymer in a desired shape and crosslinking the polymer defining its permanent crosslinked shape. Afterward, the polymer is deformed and the intended temporary shape is fixed. This process is often called programming. The programming process may consist of heating the sample, deforming, and cooling the sample, or drawing the sample at a low temperature. The permanent crosslinked shape is now stored while the sample shows the temporary shape. Heating the shape memory polymer above a transition temperature $T_{trans}$ induces the shape memory effect providing internal forces urging the crosslinked polymer toward its permanent or crosslinked shape. Alternatively or in addition to the application of an external stimulus, it is possible to apply an internal stimulus (e.g., the passage of time) to achieve a similar, if not identical result.

A crosslinked polymer network may be formed by low doses of irradiation. Polyethylene chains are oriented upon the application of mechanical stress above the melting temperature of polyethylene crystallites, which can be in the range between 60° C. and 134° C. Materials that are most often used for the production of shape memory linear polymers by ionizing radiation include high density polyethylene, low density polyethylene and copolymers of polyethylene and poly(vinyl acetate). After shaping, for example, by extrusion or compression molding, the polymer is covalently crosslinked by means of ionizing radiation, for example, by highly accelerated electrons. The energy and dose of the radiation are adjusted to the geometry of the sample to reach a sufficiently high degree of crosslinking, and hence sufficient fixation of the permanent shape.

Another example of chemical crosslinking includes heating poly(vinyl chloride) under a vacuum resulting in the elimination of hydrogen chloride in a thermal dehydrocholorination reaction. The material can be subsequently crosslinked in an HCl atmosphere. The polymer network obtained shows a shape memory effect. Yet another example is crosslinked poly[ethylene-co-(vinyl acetate)] produced by treating the radical initiator dicumyl peroxide with linear poly[ethylene-co-(vinyl acetate)] in a thermally induced crosslinking process. Materials with different degrees of crosslinking are obtained depending on the initiator concentration, the crosslinking temperature and the curing time. Covalently crosslinked copolymers made form stearyl acrylate, methacrylate, and N,N'-methylenebisacrylamide as a crosslinker.

Additionally shape memory polymers include polyurethanes, polyurethanes with ionic or mesogenic components, block copolymers consisting of polyethyleneterephthalate and polyethyleneoxide, block copolymers containing polystyrene and poly(1,4-butadiene), and an ABA triblock copolymer made from polly(2-methyl-2-oxazoline) and a poly (tetrahydrofuran). Further examples include block copolymers made of polyethylene terephthalate and polyethylene oxide, block copolymers made of polystyrene and poly(1,4-butadiene) as well as ABA triblock copolymers made from poly(tetrahydrofuran) and poly(2-methyl-2-oxazoline). Other thermoplastic polymers which exhibit shape memory characteristics include polynorbornene, and polyethylene grated with nylon-6 that has been produced for example, in a reactive blending process of polyethylene with nylon-6 by adding maleic anhydride and dicumyl peroxide.

The stopper 400 may be sealed to the container 200 in a fluid-tight or leak-free seal using shape memory properties of a selected polymer as discussed above. The stopper 400 may be formed to a desired size, having the stopper perimeter 440 larger than a corresponding inside dimension of the neck 220 of the container 200, and then crosslinked. Crosslinking of the stopper 400 sets a permanent stopper size larger than the desired inside dimension of the neck of the container. Then, installing the stopper into the opening 230 of the container 200 requires contracting the stopper perimeter 440 to fit into the neck of the container, installing the cap onto the neck, and then applying an external stimulus, such as temperature, or an internal stimulus, such as by the passage of time, for the shape memory of the polymer to tend toward its permanent shape. The expansion of the stopper perimeter within the neck of the container may be used to form a fluid-tight, leak-proof or leak-free seal, in addition to or in lieu of a seal or seals 480 as previously discussed, such as an o-ring or gasket.

The opening 230 of the container 200 is circular for typical applications, however, it is contemplated that the opening and neck around the opening may be any shape as desired. The neck and opening may have a diameter or dimension smaller than the corresponding dimension across the vessel structure of the container. Alternatively, the neck and opening may have a diameter or dimension about the same as the corresponding dimension across the vessel portion of the container.

The terms "comprising," "including," and "having," as used in the claims and specification herein, shall be considered as indicating an open group that may include other elements not specified. The terms "a," "an," and the singular form of words shall be taken to include the plural form of the same words, such that the terms mean that one or more of something is provided. The terms "at least one" and "one or more" are used interchangeably. The term "single" shall be used to indicate that one and only one of something is intended. Similarly, other specific integer values, such as "two," are used when a specific number of things are intended. The terms "preferably," "preferred," "prefer," "optionally," "may," and similar terms are used to indicate that an item, condition or step being referred to is an optional (i.e., not required) feature of the embodiments.

While the present disclosure has been described with reference to examples thereof, it shall be understood that such description is by way of illustration only and should not be construed as limiting the scope of the claimed examples. Accordingly, the scope and content of the examples are to be defined only by the terms of the following claims. Furthermore, it is understood that the features of any example discussed herein may be combined with one or more features of any one or more examples otherwise discussed or contemplated herein unless otherwise stated.

What is claimed is:

1. A reservoir for use in a water distribution system within an appliance comprising:

a container having a vessel structure terminating at a neck around an opening;

a stopper inserted into and sealingly engaging the opening within the neck, the stopper comprising:

an internal surface in communication with an interior of the container;

an external surface opposite the internal surface;

an inlet aperture and an outlet aperture through the stopper in fluid communication with the opening of the container;

a stopper cavity between the internal surface and the external surface, the stopper cavity comprising:

a first side and a second side, the first side being in fluid communication with the inlet aperture and the second side being in fluid communication with the outlet aperture; and a fluid transfer opening formed by a discontinuous cylindrical wall between the first side and the second side of the stopper cavity;

an inlet tube in fluid communication with the inlet aperture; and an outlet tube in fluid communication with the outlet aperture.

2. The reservoir of claim 1 further comprising a cap engaging the stopper and the container at the neck.

3. The reservoir of claim 2, where the cap comprises an aperture and a top lip surrounding the aperture and where the stopper further comprises a flange positioned at the external surface between the neck and the top lip of the cap.

4. The reservoir of claim 2 further comprising a threaded connection between the cap and the neck to advance the cap toward and away from the neck and where the cap is removably engaged with the neck.

5. The reservoir of claim 1 where the stopper further comprises one or more external recessed cavities adjacent the neck including a seal positioned in each of the one or more cavities.

6. The reservoir of claim 5 where the seal is an o-ring.

7. The reservoir of claim 1 further comprising a dip tube partially inserted into the second side of the stopper cavity, the dip tube being in fluid communication with the outlet tube.

8. The reservoir of claim 7, where the dip tube extends into and near the bottom of the vessel structure.

9. The reservoir of claim 7, where the dip tube is partially inserted into the discontinuous cylindrical cavity of the second side of the stopper cavity.

10. The reservoir of claim 1 where the stopper is removably engaged with the neck.

11. The reservoir of claim 1, where the discontinuous cylindrical wall extends partially into the stopper cavity.

12. The reservoir of claim 1, where the discontinuous cylindrical wall extends fully into the stopper cavity.

13. A stopper for sealingly engaging a container having an opening and a neck, the stopper configured to be inserted into the opening within the neck, the stopper comprising:

an internal surface configured to be in communication with an interior of the container;

an external surface opposite the internal surface;

an inlet aperture and an outlet aperture extending through the stopper and configured to be in fluid communication with the opening of the container a stopper cavity between the internal surface and the external surface, the stopper cavity comprising:

a first side and a second side, the first side being in fluid communication with the inlet aperture and the second side being in fluid communication with the outlet aperture; and a fluid transfer opening formed by a discontinuous cylindrical wall between the first side and the second side of the stopper cavity.

14. The stopper of claim 13 further comprising an inlet tube in fluid communication with the inlet aperture and an outlet tube in fluid communication with the outlet aperture.

15. The stopper of claim 14 further comprising an inlet tube support and an outlet tube support extending away from the external surface, where the inlet tube engages the inlet tube support and the outlet tube engages the outlet tube support.

16. The stopper of claim 15, where the stopper is overmolded onto a respective end of the inlet tube and the outlet tube creating a leak-proof connection at the inlet tube support and the outlet tube support.

17. The stopper of claim 14 further comprising a dip tube partially inserted into the second side of the stopper cavity, the dip tube being in fluid communication with the outlet tube.

18. The reservoir of claim 17, where the dip tube is partially inserted into the discontinuous cylindrical cavity of the second side of the stopper cavity.

19. The stopper of claim 13 further comprising one or more external recessed cavities adjacent the neck including a seal positioned in each of the one or more cavities.

20. The reservoir of claim 13, where the discontinuous cylindrical wall extends partially into the stopper cavity.

* * * * *